US006402938B1

(12) United States Patent
Moore et al.

(10) Patent No.: US 6,402,938 B1
(45) **Date of Patent: *Jun. 11, 2002**

(54) VAPORIZATION OF USED MOTOR OIL WITH NON-HYDROGENATING RECYCLE VAPOR

(75) Inventors: Howard F. Moore, Ashland; Arthur G. Shaffer, Jr., Grayson, both of KY (US)

(73) Assignee: Marathon Ashland Petroleum LLC, Findlay, OH (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/576,847

(22) Filed: May 23, 2000

(51) Int. Cl.[7] ..... C10M 175/00
(52) U.S. Cl. ..... 208/179; 208/184; 208/185
(58) Field of Search ..... 208/179, 184, 208/185

(56) References Cited

U.S. PATENT DOCUMENTS

| | | | |
|---|---|---|---|
| 4,101,414 | A | 7/1978 | Kim et al. |
| 5,244,565 | A | 9/1993 | Lankton et al. |
| 5,302,282 | A | 4/1994 | Kalnes et al. |
| 5,447,628 | A | 9/1995 | Harrison et al. |

*Primary Examiner*—Walter D. Griffin
*Assistant Examiner*—Tam M. Nguyen
(74) *Attorney, Agent, or Firm*—Richard D. Stone

(57) ABSTRACT

Used Motor Oil is re-refined by direct injection of a superheated, non-hydrogenating recycle vapor. The process operates at low pressures, preferably from atmospheric—10 atmospheres absolute. Preferably a significant amount of the energy required to vapor used motor oil is supplied in the form of increased sensible heat of a recycle vapor stream. Direct injection of superheated vapor reduces or eliminates fouling which can occur when indirect heat exchange is used to supply the heat needed to vaporize used motor oil.

8 Claims, 1 Drawing Sheet

VAPORIZATION OF USED MOTOR OIL WITH NON-HYDROGENATING RECYCLE VAPOR

FIELD OF THE INVENTION

The invention relates to the re-refining of used motor oil.

BACKGROUND OF THE INVENTION

Extensive work has been reported in the patent literature on use of large amounts of hot, high pressure hydrogen for vaporization of used motor oil (UMO). While such processes are certainly technically feasible, there are significant capital costs associated with the relatively high pressure operation reported (typically 500 psig). Operation at high pressure makes it difficult to vaporize the used lube oil components, so higher hydrogen addition/circulation rates are used to facilitate vaporization, with hydrogen circulation rates of 10,000–18,000 SCFB being reported. Hydrogen helps suppress some condensation coking reactions that otherwise could occur in the heating and vaporization step. The hydrogen is also present in an amount sufficient to supply the hydrogen demand of a downstream hydrotreating reactor. This combination, high-pressure hydrogen coupled with downstream hydrotreating, can produce a liquid product from a UMO fraction which is excellent for use as either a lube stock or as cracker charge.

Representative hot hydrogen: UMO processes are listed below:

| U.S. Pat. No. | Issue Date | Inventor | Title |
|---|---|---|---|
| 4,806,233 | Feb. 21, 1989 | James, Jr., et al. | Method of Separating a Hot Hydrocarbonaceous Stream |
| 4,818,368 | April 4, 1989 | Kalnes, et al. | Process for Treating a Temperature-Sensitive Hydrocarbonaceous Stream Containing a Non-Component to Produce a Hydrogenated Distillable Hydrocarbonaceous Product |
| 4,840,721 | June 20, 1989 | Kalnes, et al. | Process for Treating a Temperature-Sensitive Hydrocarbonaceous Stream Containing a Non-Distillable Component to Produce a Hydrogenated Distillable Hydrocarbonaceous Product |
| 4,882,037 | Nov. 21, 1989 | Kalnes, et al. | Process for Treating a Temperature-Sensitive Hydrocarbonaceous Stream Containing a Non-Distillable Component to Produce a Selected Hydrogenated Distillable Light Hydrocarbonaceous Product |
| 4,923,590 | May 8, 1990 | Kalnes, et al. | Process for Treating a Temperature-Sensitive Hydrocarbonaceous Stream Containing a Non-Distillable Component to Produce a Hydrogenated Distillable Hydrocarbonaceous Product |

-continued

| U.S. Pat. No. | Issue Date | Inventor | Title |
|---|---|---|---|
| 4,927,520 | May 22, 1990 | Kalnes, et al. | Process for Treating a Hydrocarbonaceous Stream Containing a Non-Distillable Component to Produce a Hydrogenated Distillable Hydrocarbonaceous Product |
| 5,004,533 | April 2, 1991 | Kalnes, et al. | Process for Treating an Organic Stream Containing a Non-Distillable Component to Produce an Organic Vapor and a Solid |
| 5,013,424 | May 7, 1991 | James, Jr., et al. | Process for the Simultaneous Hydrogenation of a First Feedstock Comprising Hydrocarbonaceous Compounds and Having a Non-Distillable Component and a Second Feedstock Comprising Halogenated Organic Compounds |
| 5,028,313 | July 2, 1991 | Kalnes, et al. | Process for Treating a Temperature-Sensitive Hydrocarbonaceous Stream Containing a Non-Distillable Component to Produce a Distillable Hydrocarbonaceous Product |
| 5,068,484 | Nov. 26, 1991 | James, Jr., et al. | Process for the Hydroconversion of a Feedstock Comprising Organic Compounds Having a Tendency to Readily Form Polymer Compounds |
| 5,102,531 | April 7, 1992 | Kalnes, et al. | Process for Treating a Temperature Sensitive Hydrocarbonaceous Stream Containing a Non-Distillable Component to Produce a Distillable Hydrocarbonaceous Product |
| 5,176,816 | Jan. 5, 1993 | Lankton, et al. | Process to Produce a Hydrogenated Distillable Hydrocarbonaceous Product |
| 5,244,565 | Sept. 14, 1993 | Lankton, et al. | Integrated Process for the Production of Distillate Hydrocarbon |
| 5,302,282 | April 12, 1994 | Kalnes, et al. | Integrated Process for the Production of High Quality Lube Oil Blending Stock |
| 5,316,663 | May 31, 1994 | James, Jr. | Process for the Treatment of Halogenated Hydrocarbons |
| 5,354,931 | Oct. 11, 1994 | Jan, et al. | Process for Hydrotreating an Organic Feedstock Containing Oxygen Compounds and a Halogen Component |
| 5,384,037 | Jan. 24, 1995 | Kalnes | Integrated Process for the Production of Distillate Hydrocarbon |
| 5,401,894 | Mar. 28, 1995 | Brasier, et al. | Process for the Treatment of Halogenated Organic Feedstocks |
| 5,552,037 | Sept. 3, 1996 | Kalnes, et al. | Process for the Treatment of Two Halogenated Hydrocarbon Streams |

-continued

| U.S. Pat. No. | Issue Date | Inventor | Title |
|---|---|---|---|
| 5,723,706 | Mar. 3, 1998 | Brasier, et al. | Process for the Treatment of Halogenated Organic Feedstocks |
| 5,817,288 | Oct. 6, 1998 | Bauer, et al. | Process for Treating a Non-Distillable Halogenated Organic Feed Stream |
| 5,904,838 | May 18, 1999 | Kalnes, et al. | Process for the Simultaneous Conversion of Waste Lubricating Oil and Pyrolysis Oil, Derived from Organic Waste to Produce a Synthetic Crude Oil |

While this approach is excellent in terms of product quality, the capital and operating expense of such an approach are significant.

We devised a vapor vaporization process that, although it does not do as much as the high-pressure, hydrogen gas process, costs significantly less to build and operate. Our vapor vaporization process does not hydrogenate the UMO to any significant extent. The capital and operating costs are low because the process operates at relatively low pressures, ranging from atmospheric to 10 atmospheres.

We devised several related vapor vaporization processes using:

high heat content vapor (e.g. methane, ethane), low pressure hydrogen, steam

BRIEF DESCRIPTION OF THE INVENTION

Accordingly the present invention provides a process for direct contact heating and vaporization of a UMO liquid hydrocarbon feed comprising lube oil boiling range hydrocarbons comprising heating a compressed recycled vapor in a heating means to produce a superheated vapor having a temperature sufficiently high to vaporize, at the conditions employed in said UMO vaporization process, at least a portion by weight of the distillable, lube oil boiling range hydrocarbon components in said UMO heating and vaporizing at least a portion of said UMO by direct contact of said UMO liquid feed with said superheated vapor in a UMO vaporization vessel operating at UMO vaporization conditions to produce a UMO vaporization vessel overhead vapor (OHV) fraction comprising vaporized UMO components and said superheated vapor and a UMO bottoms fraction comprising unvaporized UMO cooling said UMO vaporization vessel overhead fraction in a product recovery section comprising a cooling means at OHV condensation conditions including a temperature sufficiently low to condense at least a majority of the lube oil boiling range hydrocarbon components in said OHV fraction to produce a condensed liquid hydrocarbon fraction containing lube oil boiling range components as a liquid product of the process and a vapor fraction containing essentially all of said injected superheated vapor, exclusive of solution losses, if any compressing said recovered vapor fraction from said product recovery fraction to produce a compressed, recycle vapor fraction recycling said compressed vapor to said heating means of step a); and wherein said vapor, pressure and temperature in said UMO vaporization and cooling are selected to effect UMO vaporization, and condensation without hydrogenation of said UMO.

In another embodiment the present provides a heat pump, direct vapor injection, UMO vaporization process comprising heating vaporizing a liquid UMO liquid hydrocarbon feed by direct contact with a superheated vapor in a UMO vaporization vessel operating at UMO vaporization conditions to produce a UMO vaporization vessel OHV fraction comprising vaporized UMO components and said superheated vapor and a UMO bottoms fraction comprising unvaporized UMO cooling said OHV fraction in a cooling means to a temperature sufficient to condense at least a majority of normally liquid hydrocarbons present in said OHV, and wherein said cooling conditions include a temperature above ambient temperature recovering a vapor fraction above ambient temperature from said cooling separating means and heating said vapor by compressing same to form a compressed, pre-heated vapor superheating said compressed, pre-heated vapor in a fired heater or by indirect heat exchange to produce a superheated vapor stream; and recycling said compressed, superheated vapor to said UMO vaporization vessel.

BRIEF DESCRIPTION OF THE DRAWINGS

FIG. 1 is a simplified process flow diagram. UMO vaporizer or vessel 100 receives a liquid UMO feed stream via 102 and a superheated, recycle vapor stream from line 145. Injected superheated vapor and vaporized components from the UMO charge, primarily lubricating oil boiling range materials, are removed overhead via line 105 and charged to fin fan cooler 110. The cooled vapors are charged to hot separator 120, which preferably operates at a temperature low enough to condense essentially all of the lubricating oil boiling range components without condensing any water that may be present. The liquid hydrocarbon product is removed from vessel 120 via line 127, while the injected vapor is removed as a vapor via line 125. Recycle gas compressor 130 produces a compress gas stream which is charged via lines 135 and 165 to heater 140 to produce a superheated vapor stream which is recycled via line 145 to vessel 100. At least periodically a liquid, residue fraction is withdrawn from vessel 100 via line 147.

COMPUTER SIMULATION

Figure 1:
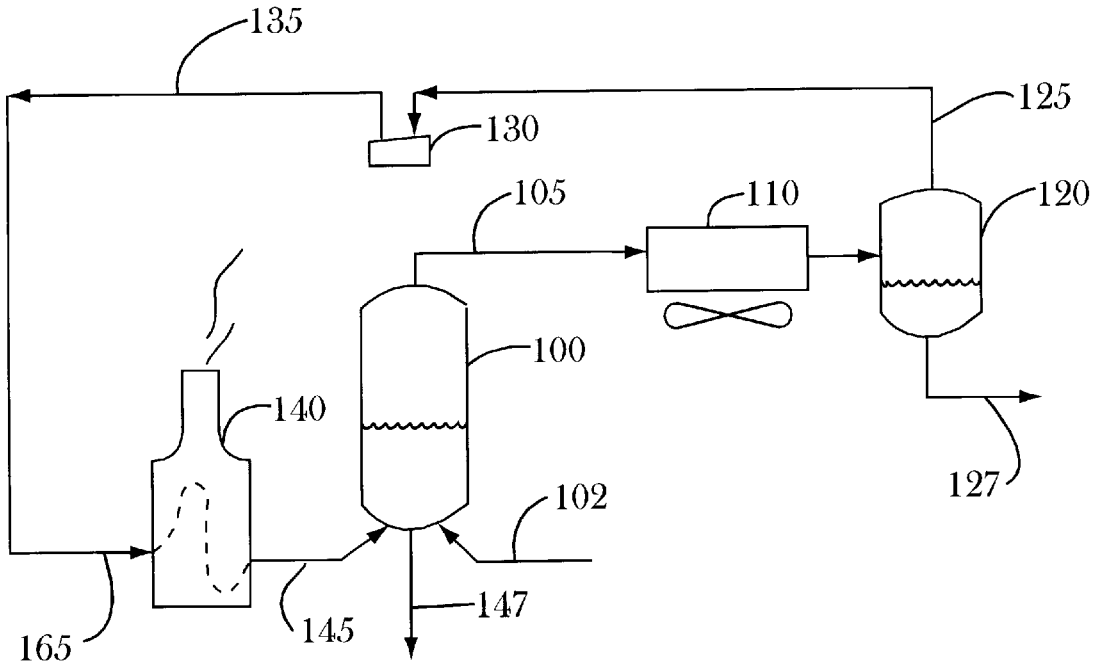
FIG. 1 is a simplified process flow diagram from which most pumps, heat exchangers and the likes have been omitted.

The examples that follow are based upon computer simulations, using computer programs that have proven reliable for predicting the performance of various refinery units in the past. The computer simulations are consistent with, but not directly comparable to, a limited amount of laboratory test work done with steam. As an example of the difference between the two approaches, the computer simulation predicts an end of run thermal reactor temperature a few degrees different than an actual test result. The difference is not believed significant and probably is due to the difficulty of maintaining relatively small pilot plant size equipment at a high temperature in a cold room.

This computer simulation is reliable and is used to design refinery fractionation towers, etc. and a commercial scale UMO plant.

The computer simulations that follow are side-by-side comparisons of different working fluids and different approaches (recycling a vapor by compressing it versus once through operation or pumped recycle vapor).

In all cases, the same general process flow sequence was followed, i.e. pre-flash to remove light ends and water from UMO followed by batch vaporization in a vessel.

In all cases, hot UMO vaporizer overhead vapors were heat exchanged against the vapor charged to the reactor. This reduced the temperature of the UMO vapor from 584–675° F. (depending on the working fluid and other process conditions) to a temperature below 500° F. This cooled, but still essentially vapor phase, UMO overhead material was then heat exchanged against the UMO feed to the pre-flash. Fin-fan coolers then cooled and condensed the lubricating oil boiling range components in the UMO vaporizer overhead vapors, leaving most, and preferably essentially all, of the injected vapor in the vapor phase. Condensed hydrocarbon liquid was recovered in a hot separator operating at a temperature of 300° F. for this exercise. Hot separator liquid was then heat exchanged against incoming, ambient temperature UMO feed to provide a measure of preheat of the UMO feed prior to heat exchange of UMO feed with hot UMO vaporizer vapors.

This approach to, and amount of, heat exchange was considered a reasonable compromise for a commercial plant. Further heat savings could be achieved by adding more heat exchanger capacity, but this increased the cost and complexity of the plant. This approach did allow a fair comparison of different working fluids.

In the tables that follow, the following abbreviations have been used and are listed below with their accompanying definitions:

ULO (or UMO) Cold Feed is the filtered, raw UMO feed to the plant.

Pre-flash Drum Vapor refers to the overhead vapors from the pre-flash. The pre-flash preferably removes at least 80% of the water, chlorinated solvents, and gasoline boiling range components from the UMO feed.

Hot ULO Charge to Reactors refers to the pre-heated feed to each vaporizing vessel.

Thermal Reactor Vapor refers to the overhead vapors from each vaporizing reactor. The numbers reported are averaged over the entire heat cycle.

Residue Product refers to the bottoms fraction remaining in each vaporization reactor after completion of a heat cycle.

Gas Oil Rec.Vapor refers to the overhead vapor fraction from the hot separator or gas oil receiver. This operates at roughly 300° F. in these examples.

Gas Oil Product refers to the liquid fraction removed from the hot separator. It contains essentially all of the lubricating oil boiling range components and is similar to, and may be substituted for or blended with, gas oil charge to an FCC unit.

Oily Wastewater Product is the liquid water phase resulting when pre-flash overhead vapors and injected steam in the gas oil rec. vapor are cooled and condensed.

S.H. Steam-to-Reactors refers to the amount of Super-Heated steam (or other working fluid as the case may be) charged to each vaporization reactor during a heat cycle.

In the examples which follow, three different vaporizing gases are used methane, propane and hydrogen.

All three gases are essentially inert at the conditions experienced in the UMO vaporizer.

All three gases provide for a system that is essentially closed, i.e. no vapor streams need be vented or flared from the process.

Although the cases have not been optimized, they do show that a significant amount of heat recovery is possible by taking the vapor phase from the hot separator (120 in FIG. 1) and compressing this to a higher pressure for recycle. Compression heats the gas so that less fuel need be burned in the furnace to achieve the desired degree of superheat. The situation is somewhat comparable to use of a heat pump to heat a house as opposed to use of a fired heater; the heat pump can be much more thermally efficient. What is unique about this application is that the working fluid, the compressed methane or hydrogen, can be directly injected into the UMO for direct contact heating thereof. This eliminates the need for heat exchanger surface and the fouling associated therewith. Direct contact heat exchange allows the UMO temperature to approach within a few degrees of the injected superheated vapor; in contrast, heat exchangers typically require 10–50° F. differential temperature. Finally, some beneficial work is achieved from the injected superheated vapor in that it agitates, or stirs, the UMO in the vaporizer.

| | Stream No. | | | | | | | | | |
|---|---|---|---|---|---|---|---|---|---|---|
| Stream Description | 1 ULO Cold Feed | 2 Preflash Drum Vapor | 3 Hot ULO Charge to Reactors | 4 Thermal Reactor Vapor | 5 Residue Product | 6 Gas Oil Rec. Vapor | 7 Gas Oil Product | 8 Oily Wastewater Product | 9 Circulating Gas | 10 Fuel Gas Makeup |
| ULO REPROCESSING - HYDROGEN GAS VAPORIZING | | | | | | | | | | |
| M3/HR | 7.29 | 888.45 | 6.59 | 12,446.50 | 1.21 | 12,165.69 | 5.33 | 0.73 | 12,160.97 | 429.47 |
| KG/HR. Hydrocarbon | 5,849 | 37 | 5,813 | 5,732 | 1,162 | 1,103 | 4,628 | 58 | 1,080 | 45 |
| KG/HR. Water | 672 | 670 | 2 | 62 | 0 | 62 | 0 | 670 | 60 | 0 |
| MOL. WT. | 123.4 | 18.8 | 378.9 | 11.0 | 590.0 | 2.3 | 389.9 | 19.3 | 2.2 | 2.1 |
| MOL. HR. | 52.9 | 37.5 | 15.3 | 525.4 | 2.0 | 513.5 | 11.9 | 37.6 | 513.3 | 18.1 |
| API (sp. gr.) | 28.6 | (0.65) | 28.7 | (0.38) | 14.9 | (0.08) | 31.2 | (1.0) | (0.08) | (0.07) |
| Process Conditions | | | | | | | | | | |
| Temp ° F. | 60 | 250 | 300 | 582 | 680 | 250 | 180 | 100 | 287 | |
| Temp ° C. | | | | | | | | | | |

-continued

| Stream Description | 1 ULO Cold Feed | 2 Preflash Drum Vapor | 3 Hot ULO Charge to Reactors | 4 Thermal Reactor Vapor | 5 Residue Product | 6 Gas Oil Rec. Vapor | 7 Gas Oil Product | 8 Oily Wastewater Product | 9 Circulating Gas | 10 Fuel Gas Makeup |
|---|---|---|---|---|---|---|---|---|---|---|
| | Stream No. | | | | | | | | | |
| Pressure | | | | | | | | | | |
| PSIG | 20 | 10 | 50 | 20 | 15 | 10 | 25 | 20 | 50 | |
| | ULO REPROCESSING - METHANE GAS VAPORIZING | | | | | | | | | |
| M3/HR | 7.29 | 888.45 | 6.59 | 9,365.85 | 1.21 | 9,082.68 | 5.33 | 0.73 | 9,079.14 | 149.84 |
| KG/HR. Hydrocarbon | 5,849 | 37 | 5,813 | 10,796 | 1,162 | 6,162 | 4,635 | 54 | 6,145 | 102 |
| KG/HR. Water | 672 | 670 | 2 | 73 | 0 | 73 | 0 | 670 | 71 | 0 |
| MOL. WT. | 123.4 | 18.8 | 378.9 | 27.5 | 590.0 | 16.2 | 388.1 | 19.3 | 16.2 | 16.0 |
| MOL. HR. | 52.9 | 37.5 | 15.3 | 395.3 | 2.0 | 383.4 | 11.9 | 37.6 | 383.2 | 6.4 |
| API (sp. gr.) | 28.6 | (0.65) | 28.7 | (0.95) | 14.9 | (0.56) | 31.2 | (1.0) | (0.56) | (0.55) |
| Process Conditions | | | | | | | | | | |
| Temp ° F. | 60 | 250 | 250 | 596 | 694 | 250 | 180 | 100 | 315 | |
| Temp ° C. | | | | | | | | | | |
| Pressure | | | | | | | | | | |
| PSIG | 20 | 5 | 50 | 20 | 15 | 10 | 25 | 20 | 50 | |
| | ULO REPROCESSING - PROPANE GAS VAPORIZING | | | | | | | | | |
| M3/HR | 7.29 | 888.45 | 6.59 | 6,514.09 | 1.21 | 6,222.66 | 5.37 | 0.72 | 6,229.74 | 71.97 |
| KG/HR. Hydrocarbon | 5,849 | 37 | 5,813 | 15,748 | 1,163 | 11,092 | 4,657 | 50 | 11,098 | 133 |
| KG/HR. Water | 672 | 670 | 2 | 221 | 0 | 221 | 0 | 670 | 219 | 0 |
| MOL. WT. | 123.4 | 18.8 | 378.9 | 58.1 | 590.0 | 43.1 | 378.2 | 19.2 | 43.0 | 44.1 |
| MOL. HR. | 52.9 | 37.5 | 15.3 | 275.0 | 2.0 | 262.7 | 12.3 | 37.6 | 262.9 | 3.0 |
| API (sp. gr.) | 28.6 | (0.65) | 28.7 | (2.01) | 14.9 | (1.49) | 31.4 | (1.0) | (1.49) | (1.52) |
| Process Conditions | | | | | | | | | | |
| Temp ° F. | 60 | 250 | 300 | 607 | 701 | 250 | 180 | 100 | 198 | |
| Temp ° C. | | | | | | | | | | |
| Pressure | | | | | | | | | | |
| PSIG | 20 | 10 | 50 | 20 | 15 | 10 | 25 | 20 | 50 | |

PRE-FLASH

Many UMO streams contain significant amounts of volatile, light components ranging from chlorinated solvents to gasoline, from crankcase dilution to unknown materials dumped in the UMO or picked up in some part of the collection process, to water.

It will be beneficial if the UMO is subjected to a pre-flash, or initial heating, to remove much or all of the volatile organic chlorides and/or some or all of the gasoline boiling range components and water which may be present. This ensures that if a UMO collector brings in a bad batch of UMO, with excessive amounts of chlorinated solvent, then the chlorinated solvents will be largely removed upstream of the UMO thermal reactors/vaporizers. Use of a pre-flash will increase the capital cost of the process to some extent in requiring an isolated, overhead receiver dedicated to the pre-flash column. There is little change in operating expense because all distillable compounds, at least those distillable at temperatures below, e.g., 500° F., will be removed at some point in the process, so there is no increase in energy consumption by flashing upstream of the thermal reactor/vaporizers. An additional benefit of a pre-flash section is that low-grade heat may be used to pre-heat/heat the UMO to the desired pre-flash temperature. The pre-flash will typically operate at around 225° F.–500° F., preferably 250° F.–400° F., and most preferably 275° F.–350° F.

The pre-flash preferably operates at near atmospheric pressure, but may operate under vacuum, e.g. 0.1 to 1.0 atmospheres, absolute. The pre-flash may operate at somewhat higher pressures to be compatible with parts of the UMO plant, e.g. from 1 to 20 atmospheres.

The process of the present invention works well when the recycle vapor is selected from the group of light hydrocarbon gases, steam and hydrogen.

Preferably the superheating vapor has a thermal capacity at least twice that of hydrogen, on a molar basis, more preferably at least five times that of hydrogen.

The process works well when relatively modest amounts of recycle vapor are used. Normally less than 10,000 SCFB of recycle vapor will be injected into the UMO thermal reactors/vaporizers. Preferably less than 5,000 SCFB of recycled vapor is injected.

Preferably a significant amount, at least 5%, of the heat input required to vaporize UMO is supplied by increasing the temperature of the recycled vapor fraction by compressing it. More preferably, at least 10% of the heat input is achieved by direct compression, and most preferably 20% or more of the heat input is supplied by compression.

What is claimed is:

1. A process for direct contact heating and vaporization of a used motor oil (UMO) liquid hydrocarbon feed comprising lube oil boiling range hydrocarbons comprising:

a) heating a compressed recycled vapor in a heating means to produce a superheated vapor having a temperature sufficiently high to vaporize, at the conditions employed in said UMO vaporization process, at least a portion by weight of the distillable, lube oil boiling range hydrocarbon components in said UMO;

b) heating and vaporizing at least a portion of said UMO by direct contact of said UMO liquid feed with said superheated vapor in a UMO vaporization vessel operating at UMO vaporization conditions to produce a UMO vaporization vessel overhead vapor (OHV) fraction comprising vaporized UMO components and said superheated vapor and a UMO bottoms fraction comprising unvaporized UMO;

c) cooling said UMO vaporization vessel overhead fraction in a product recovery section comprising a cooling means at OHV condensation conditions including a temperature sufficiently low to condense at least a majority of the lube oil boiling range hydrocarbon components in said OHV fraction to produce a condensed liquid hydrocarbon fraction containing lube oil boiling range components as a liquid product of the process and a vapor fraction containing essentially all of said injected superheated vapor, exclusive of solution losses, if any;

d) compressing said recovered vapor fraction from said product recovery fraction to produce a compressed, recycle vapor fraction;

e) recycling said compressed vapor to said heating means of step a); and f) wherein said vapor, pressure and temperature in said UMO vaporization and cooling are selected to effect UMO vaporization, and condensation without hydrogenation of said UMO.

2. The process of claim 1 wherein said UMO vaporization conditions include a pressure of 1–10 atmospheres, absolute.

3. The process of claim 1 wherein said recycled vapor is a light hydrocarbon gas.

4. The process of claim 1 wherein said recycled vapor is steam.

5. The process of claim 1 wherein said recycled vapor is hydrogen.

6. The process of claim 1 wherein said recycled vapor has a thermal capacity twice that of hydrogen on a molar basis.

7. The process of claim 1 wherein less than 10,000 SCFB of recycled vapor is added.

8. The process of claim 1 wherein at least 10% of the heat input required to vaporize UMO is supplied by increasing the temperature of the recycled vapor fraction by compressing it.

* * * * *